US011851953B2

(12) United States Patent
Jathmi

(10) Patent No.: US 11,851,953 B2
(45) Date of Patent: Dec. 26, 2023

(54) MAST SAFETY SYSTEM

(71) Applicant: SAUDI ARABIAN OIL COMPANY, Dhahran (SA)

(72) Inventor: Mohammed Ali Jathmi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 789 days.

(21) Appl. No.: 16/867,031

(22) Filed: May 5, 2020

(65) Prior Publication Data

US 2021/0347616 A1 Nov. 11, 2021

(51) Int. Cl.

| | |
|---|---|
| ***B66D 5/00*** | (2006.01) |
| ***E21B 15/00*** | (2006.01) |
| ***E04H 12/34*** | (2006.01) |
| ***B66D 5/04*** | (2006.01) |
| *B66D 1/14* | (2006.01) |

(52) U.S. Cl.

CPC ..... *E21B 15/00* (2013.01); *B66D 5/04* (2013.01); *E04H 12/345* (2013.01); *B66D 1/14* (2013.01)

(58) Field of Classification Search

CPC .. B66D 5/04; B66D 1/14; E21B 15/00; E21B 19/008; E04H 12/345; A01K 89/05; A01K 89/051; A01K 89/052; A01K 89/056; A01K 89/01557

See application file for complete search history.

(56) References Cited

U.S. PATENT DOCUMENTS 3,244,242 A 4/1966 Wolff
3,483,933 A 12/1969 Dyer et al.
3,552,676 A 1/1971 Weber
4,448,290 A * 5/1984 Reid, Jr. ..... B66D 5/04 188/189
4,478,015 A 10/1984 Lawrence et al.
4,587,778 A 5/1986 Woolslayer et al.

(Continued)

FOREIGN PATENT DOCUMENTS

CN 201934030 U 8/2011
CN 204532122 U 8/2015

(Continued)

OTHER PUBLICATIONS

International Search Report and Written Opinion issued in Application No. PCT/US2020/034646, dated Apr. 30, 2021 (22 pages).

*Primary Examiner* — Emmanuel M Marcelo

(74) *Attorney, Agent, or Firm* — Osha Bergman Watanabe & Burton LLP

(57) ABSTRACT

A spool may include a drum rotatably supported on an axle shaft and flanges integrally formed with opposite ends of the drum. The drum has a continuous groove on the outer surface of the drum to guide the movement of the safety wireline. Both of the flanges may include an opening, internal threads circumscribing the opening, and a plurality of mechanical brakes. Each of the mechanical brakes may include a rotor rotatably supported on the axle shaft of the spool and a pawl arranged within the opening. The pawl is pivotally linked to the rotor such that when the rotation of the axle shaft is in a direction and at a rotation speed that exceeds a threshold then the pawl is moved by centrifugal force and engages with the internal threads circumscribing the opening and does not permit the spool to rotate.

19 Claims, 12 Drawing Sheets

(56) References Cited

U.S. PATENT DOCUMENTS

| | | | | |
|---|---|---|---|---|
| 4,630,425 | A | 12/1986 | Reed | |
| 5,186,289 | A * | 2/1993 | Wolner | F16D 59/00 188/65.1 |
| 5,782,420 | A * | 7/1998 | Forslund | A01K 89/01557 242/322 |
| 9,096,282 | B2 | 8/2015 | Smith et al. | |
| 2009/0200856 | A1 | 8/2009 | Chehade et al. | |
| 2013/0105283 | A1 | 5/2013 | Dudek et al. | |
| 2017/0253469 | A1 | 9/2017 | Hall et al. | |

FOREIGN PATENT DOCUMENTS

| | | | |
|---|---|---|---|
| CN | 206680109 | U | 11/2017 |
| CN | 208981984 | U | 6/2019 |
| EA | 3054079 | | 8/2016 |
| KR | 200339596 | Y1 | 1/2004 |
| WO | 9726208 | A1 | 7/1997 |
| WO | 2009001133 | A2 | 12/2008 |

* cited by examiner

MAST SAFETY SYSTEM

FIELD

The disclosure relates to a safety system and a method for using a mast system.

BACKGROUND

A mast is a structural tower comprised of one or more sections that are assembled on the ground in a horizontal position. A mast is generally raised to an operating position by using a hoisting system and wires coupling the mast to the hoisting system. Such masts are rectangular or trapezoidal in shape and used to hold drilling equipment in a desired location. Once a mast is raised to the operating position, the mast stays erect while the drilling equipment carries out its mission. If the drilling equipment needs to be moved, wires may be used to couple the drilling equipment to the hoisting system where the wires pass through the mast such a way that the location of the drilling equipment may be controlled by the hoisting system.

SUMMARY

In accordance with one or more embodiments, a spool may include an axle shaft rotatably supporting the drum and flanges integrally formed with opposite ends of the drum. Both of the flanges of the spool may include an opening, internal threads circumscribing the opening, and a plurality of mechanical brakes. Each of the mechanical brakes may include a rotor rotatably supported on the axle shaft and a pawl where both the rotor and the pawl are arranged within the opening. The pawl is pivotally linked to the rotor such that when the rotation of the axle shaft is in a rotation direction and at a rotation speed that exceeds a threshold then the pawl is moved by centrifugal force and engages with the internal threads circumscribing the opening and does not permit the spool to rotate. The spool may further include an S-shaped plate with an aperture at the center to guide the rotation of the axle shaft and a torsion spring configured to attenuate vibration and to maintain positions of the rotor and the S-shaped plate. The spool may further include a flapper leg with a compression spring configured to limit motion of the S-shape plate and to retain the pawl from locking in normal speed.

A system in accordance with one or more embodiments may include a spool and a safety wireline coupling between the spool and a mast. The safety wireline may include a first end and a second end, where the first end is anchored to a drum of the spool and the second end is configured to be coupled to the mast. A three-point connector may be used to couple the mast with the spool by coupling a first point of the three-point connector to the second end of the safety wireline and coupling each of the second and third points to a separate sling wire, where each sling wire is configured to be coupled to the mast at different points. The coupling of the safety wireline to the mast is such that each sling wire, the three-point connector and the safety wireline do not contact a drilling line from the drawworks. The system may further include a shock absorber jack coupled to each of the sling wires to attenuate vibrations. An external drive may be used to rotate the spool such that the safety wireline coupled to the mast is retrieved when the spool is engaged with the external drive.

In accordance with one or more embodiments, a method of using a system begins with coupling a safety wireline to a mast by using a three-point connector, a plurality of sling wires, and a plurality of shock absorber jacks, where a first end of the safety wireline is coupled to a wall of a drum in a spool. A drawworks may be used to move the mast, and the spool may be rotated in coordination with the drawworks such that the position of a pawl in a mechanical brake on the spool is maintained in a first position. The first position of the pawl in the mechanical brake of the spool permits the spool to rotate, and a second position of the pawl in the mechanical brake engages the pawl with internal threads of the spool and does not permit the spool to rotate. The pawl is pivotally linked in the spool such that when a rotation occurs and a rotation speed exceeds a threshold then the pawl is moved from the first position to the second position by centrifugal force.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. For the sake of continuity, and in the interest of conciseness, same or similar reference characters may be used for same or similar objects in multiple figures. Further, the particular shapes of the elements as drawn are not necessarily intended to convey any information regarding the actual shape of the particular elements and have been solely selected for ease of recognition in the drawing.

DETAILED DESCRIPTION

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the safety system has not been shown or described in detail to avoid unnecessarily obscuring descriptions of the implementations and embodiments.

A safety system in accordance with one or more embodiments may provide a safety measure to a mast system by introducing a separately independent spool and coupling a mast to the spool with wires and other components. This spool may provide a safety measure to the mast even if a failure occurs in the hoisting system or in its operation, such as a failure in power supply, a fatigue failure in one of internal components of the hoisting system, or human error. The spool in accordance with one or more embodiments may include an axle shaft, a drum rotatably supported by the axle shaft, and a mechanical brake. The safety system may be activated upon a sudden increase in centrifugal force on the spool generated by falling of the mast. The mechanical brake then stops and locks further rotation of the axle shaft, which locks the spool, and prevents the mast from falling any further due to the coupling between the mast and the spool.

Figure 1:
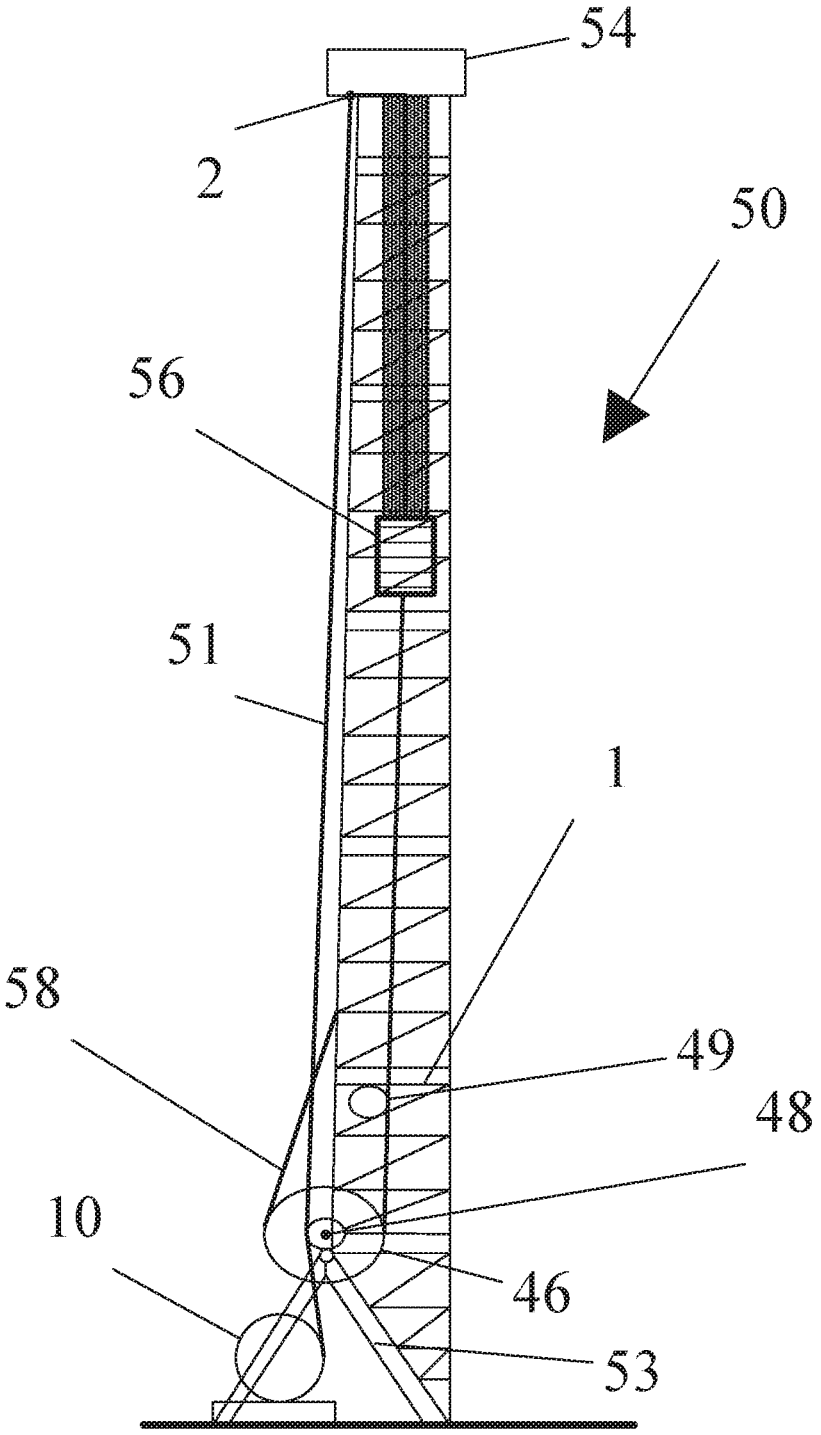
FIG. 1 shows a side view of a mast system.

FIG. 1 shows a side view of a mast system 50 including a mast 1, a traveling block 56, a crown block 54, a drawworks 10 disposed under a support 53, a drilling line 51 in part wound around the drawworks 10. The drilling line 51 passes through a location 2 at a crown block 54 and extends further to the traveling block 56 where the traveling block 56 couples the drilling line 51 and raising lines 58 in the middle of the mast 1. The raising lines 58 are anchored at the mast 1 at one end while the other end is coupled to the traveling block 56. The raising lines 58 are in part wound around the raising sheaves 46 that are disposed at the sides of the support 53 whereas the drilling line 51 is in part wound around a drilling sheave 48 that is disposed in the middle of the support 53. Side sheaves 49 may be disposed on sides of the mast 1 to guide the movement of the raising lines 48. This provides additional structural integrity during raising operation where the drawworks 10 is pulling the drilling line 51 that is coupled to the raising line 58 at the traveling block 56.

Figure 2:
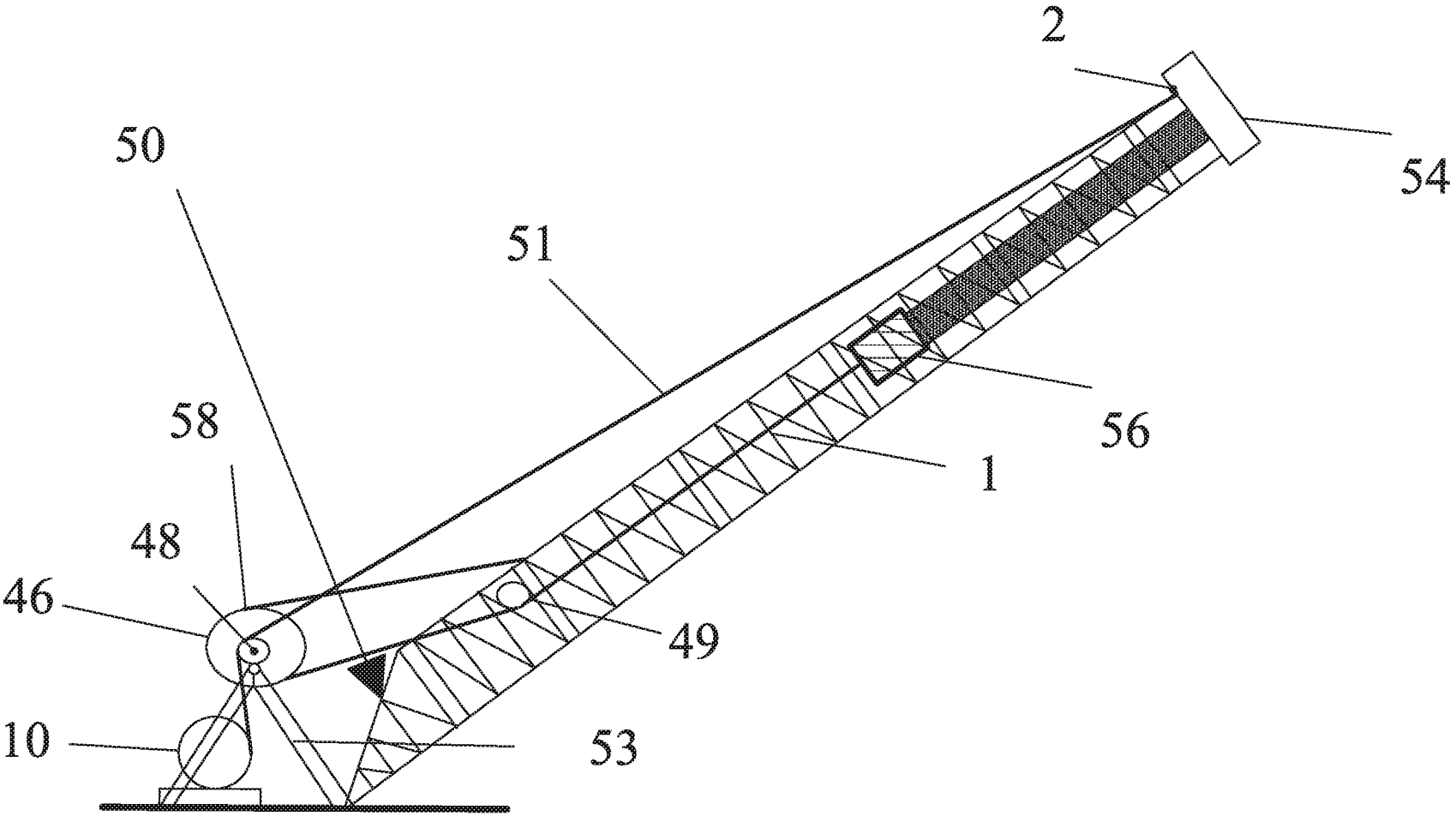
FIG. 2 shows a side view of a mast system during operation.

In more details, FIG. 2 shows a side view of the mast system 50 in FIG. 1 where the mast 1 is being raised to an operating position. The drilling line 51 is anchored at the drawworks 10 at one end while the other end is coupled to the raising lines 58 at the traveling block 56 after passing through the location 2 at the crown block 54 on the mast 1. During such raising operations, the movement of the drilling line 51 is guided by the drilling sheave 48 and the movement of the raising lines is guided by the raising sheaves 46 on the sides of the support 53 and the side sheaves 49 on the mast 1.

Figure 3:
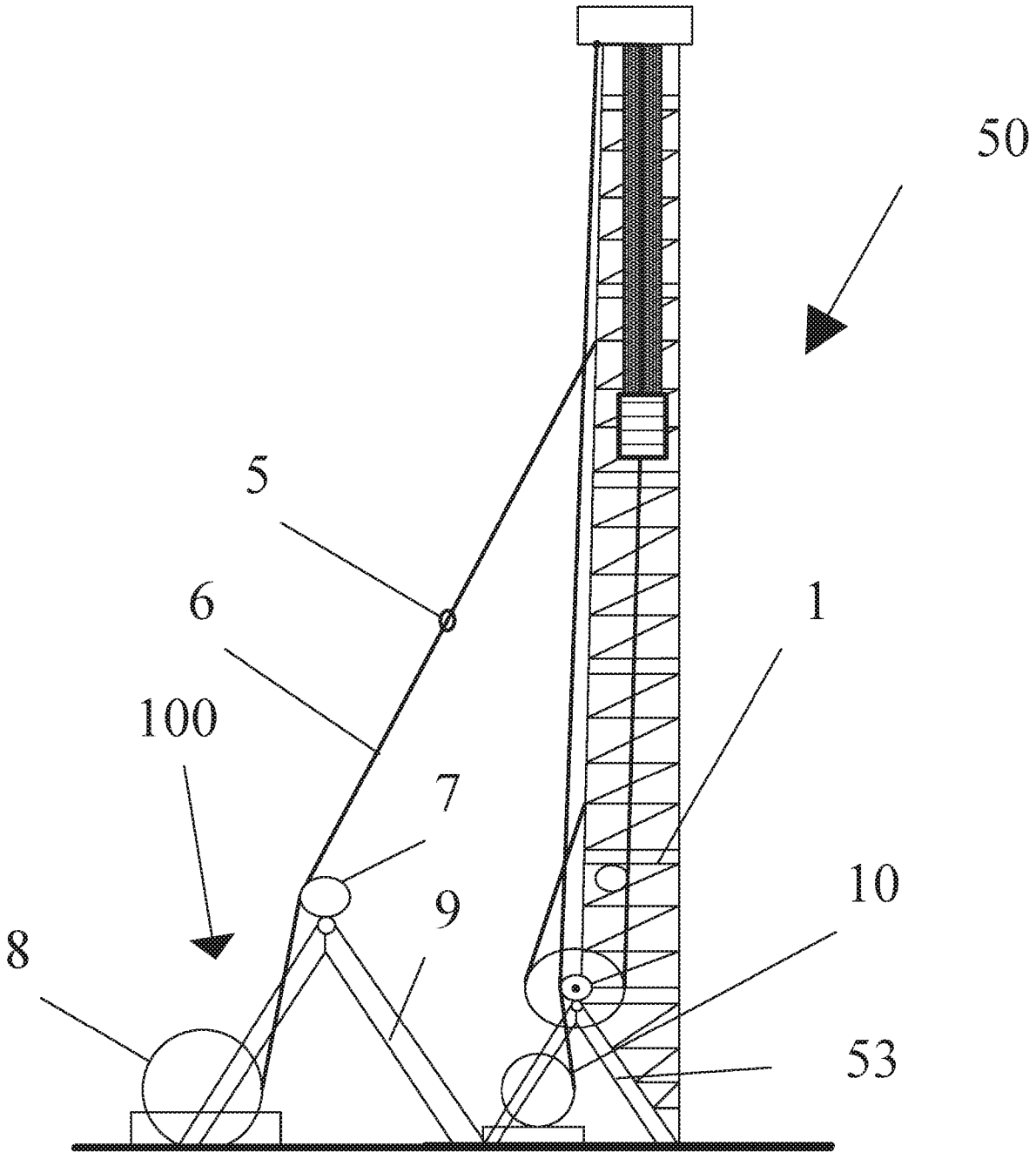
FIG. 3 shows a side view of a safety system in accordance with one or more embodiments coupled to the mast system in FIG. 1.

FIG. 3 shows a side view of a safety system 100 in accordance with one or more embodiments in combination with the mast system 50 as shown previously in FIG. 1. The safety system 100 includes an A-frame 9 and a separately independent spool 8 disposed next to a support 53. The A-frame 9 includes a sheave 7 that has a groove on its outer surface that comes in surface contact with a safety wireline 6. This ensures that the sheave 7 guides the movement of the safety wireline 6 to avoid any undesired whipping or vibrations of the safety wireline 6. The spool 8 is configured to brake and lock the rotation of the axle shaft upon a sudden increase in centrifugal force in order to halt the mast 1 from falling further. The safety wireline 6 has one end coupled to the spool 8 and the other end coupled to a three-point connector 5 that is further connected to the mast 1 by other components. One skilled in the art would appreciate how the mast system 50 may be arrested from continuing to fall even if the drawworks 10 fails because the mast 1 is concurrently coupled to the safety system 100 that works separately from the drawworks 10. The spool can prevent the mast 1 from falling due to the coupling between the spool 8 and the mast 1 with the safety wireline 6 and the other components, which will be explained in the following description in more details.

Figure 4:
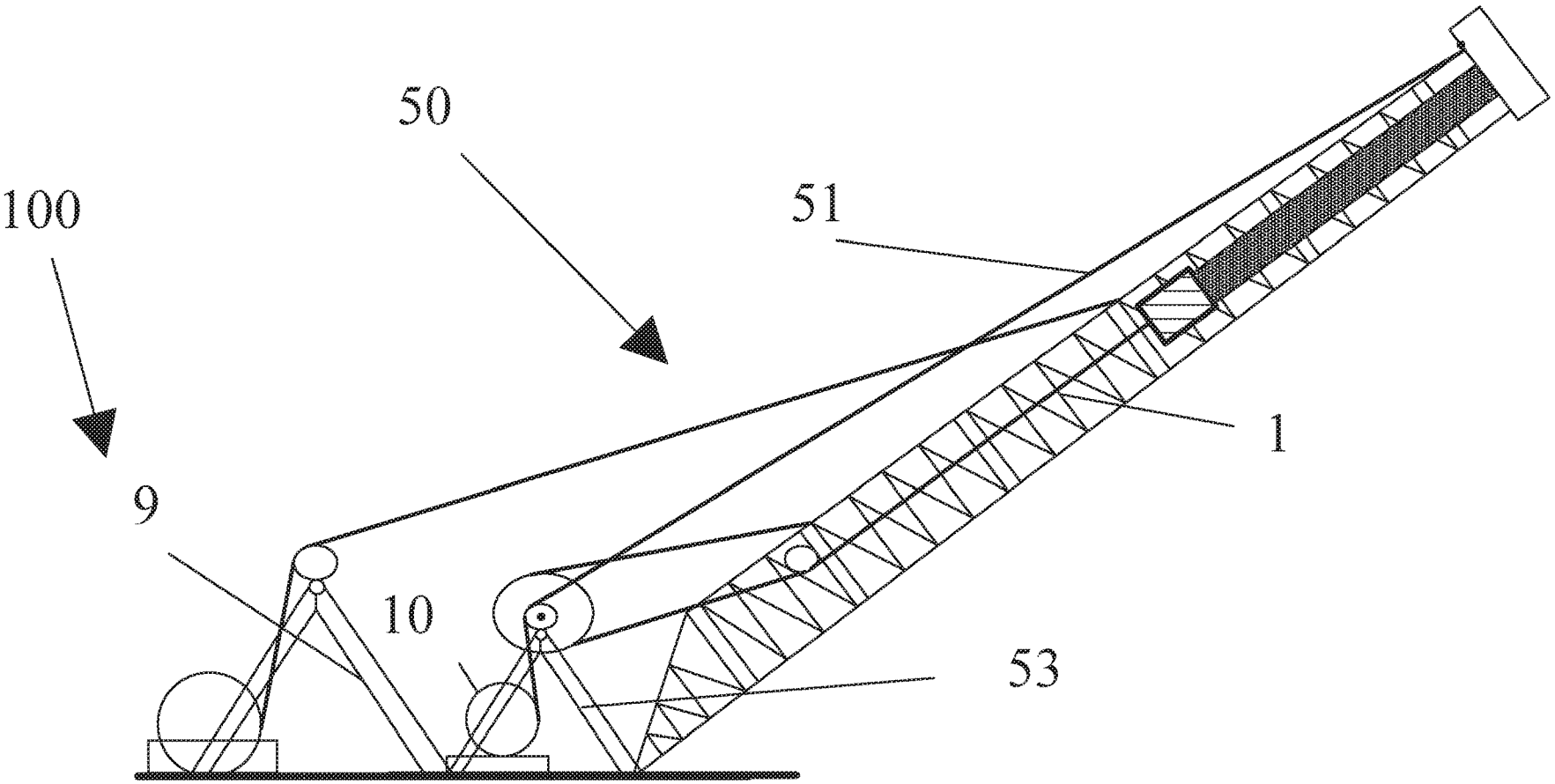
FIG. 4 shows a side view of a safety system in accordance with one or more embodiments coupled to the mast system in FIG. 2.
Figure 5:
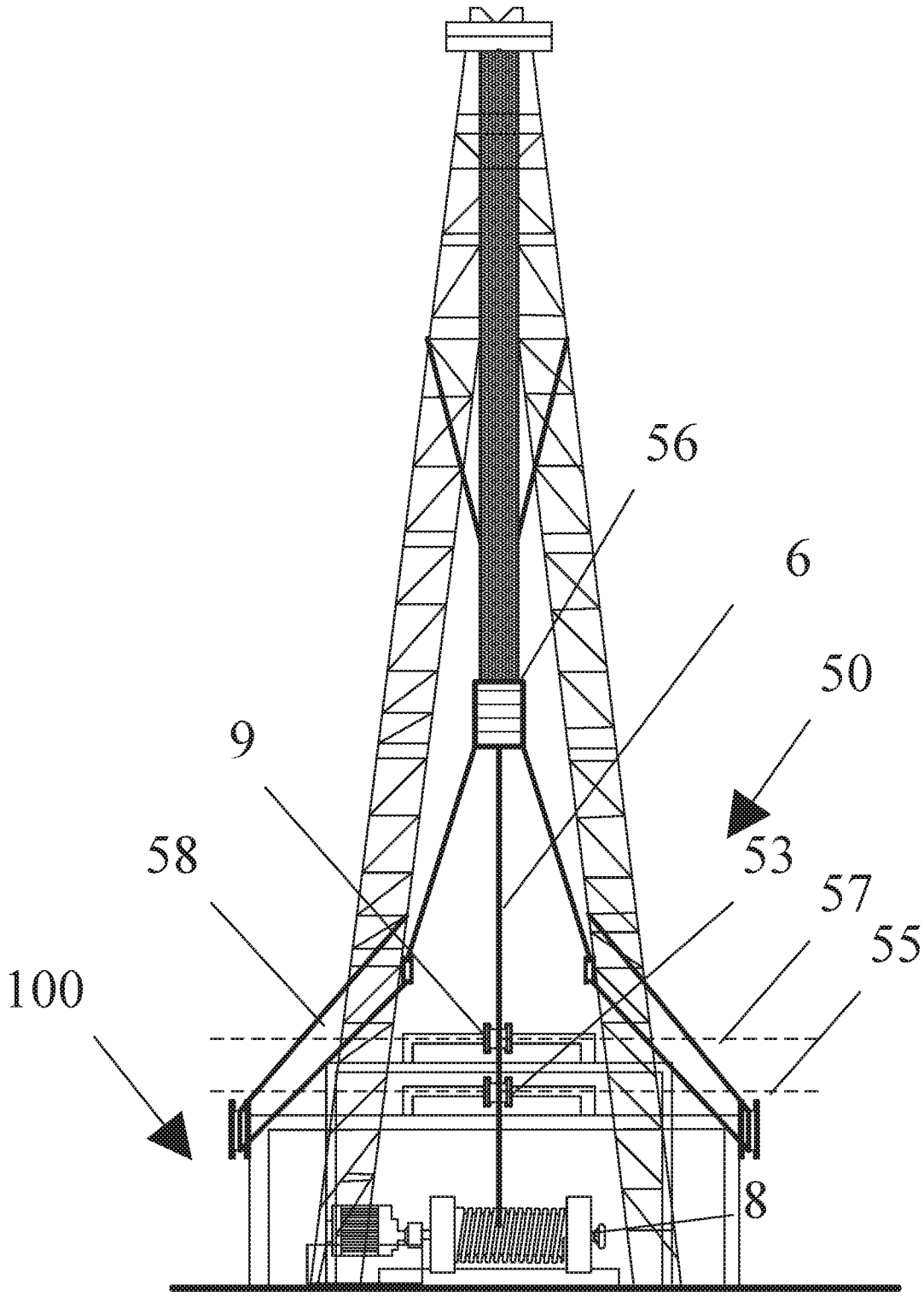
FIG. 5 shows a rear view of a safety system in accordance with one or more embodiments.

FIG. 4 illustrates an application of a safety system 100 to a mast system 50 in accordance with one or more embodiments where a mast 1 is being raised to an operating position. The mast 1 is coupled to an A-frame 9 that is holding the mast 1 at a different level than that of a support 53, which is better described in FIG. 5 showing a rear view of FIG. 4. A drilling line 51 bears the weight of the mast 1 while the mast 1 is being raised to the operating position by a drawworks 10. The mast 1 must fall uncontrollably for a short respond time to generate the centrifugal force to activate the safety system 100. The respond time in accordance with one or more embodiments may be between 1 and 1.5 seconds.

FIG. 5 shows a rear view of an application of a safety system 100 to a mast system 50 in accordance with one or more embodiments where a spool 8 is disposed under an A-frame 9 that guides a safety wireline 6 at a level 57 whereas a support 53 guides a drilling line at a level 55. This is to guide the safety wireline 6 at a different height from that of the drilling line in order to avoid any undesired contacts between the drilling line and the safety wireline 6. Further, the safety wireline 6 is not contacted with a traveling block 56 that couples the drilling line and raising lines 58. This further provides different points of contact and angles with respect to the mast 1 for improved structural integrity while the mast 1 is being raised to an operating position.

Figure 6:
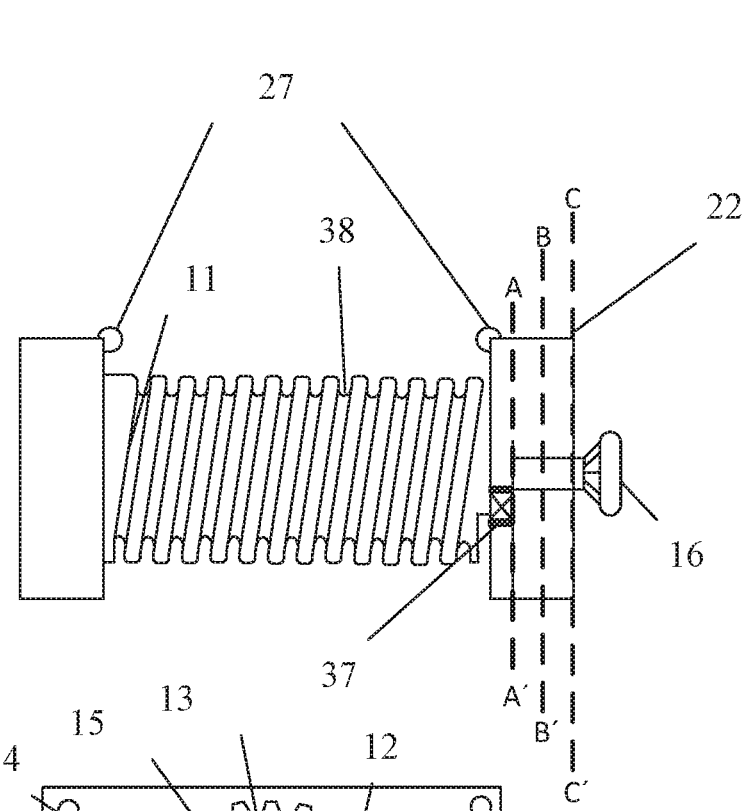
FIG. 6 shows a spool in accordance with one or more embodiments.
Figure 6A:
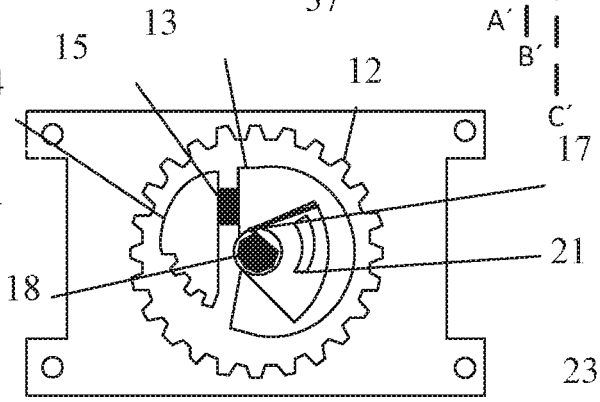
FIGS. 6A, 6B, and 6C show a corresponding side view on plane cross-sections AA', BB', and CC', respectively, of FIG. 6.
Figure 6B:
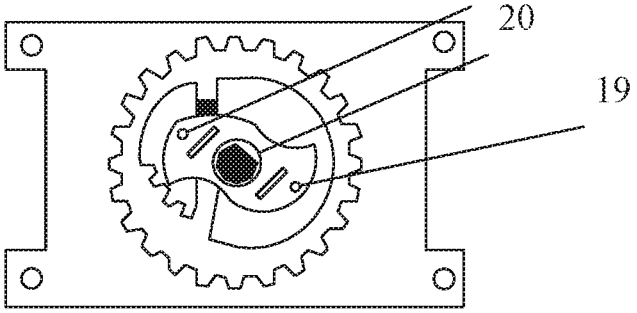
Figure 6C:
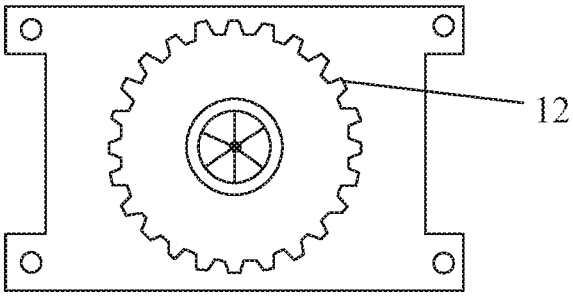

FIG. 6 illustrates a spool 8 in accordance with one or more embodiments. FIGS. 6A, 6B, and 6C correspond to plane views of AA', BB', and CC', respectively, of FIG. 6. The spool 8 typically would have at least some of the safety wireline coiled around it; however, for simplicity of the drawing and discussion the safety wireline has been omitted from FIG. 6. A drum 11 of the spool 8 rotates on an axle shaft when lowering the mast and its rotation is aligned with the pulling of a drawworks. The outer surface of the drum 11 has grooves 38 on it that guides the safety wireline as it winds around the drum 11 so that the safety wireline wraps evenly and continuously. The safety wireline is affixed to the wall 37 of the drum 11. One skilled in the art would appreciate how even and continuous wrapping would keep the drum 11 balanced and prevents the safety wireline from whipping back and forth in the air between the longitudinal ends of the drum 8.

The drum 11 has flanges 22 at both sides that have an opening with internal threads 12, as shown in FIG. 6A. A pawl 14 and a rotor 13 are arranged within the opening with internal threads 12 and stop the rotation of the drum 11 once the pawl 14 is moved outwardly. The pawl 14 is received into the internal threads 12 upon a sudden increase in centrifugal force. For example, when a mast falls, a safety wireline coupling the mast and the spool rapidly accelerates the rotation rate of the drum 11, which results in an increase in centrifugal force on the drum 11. The increase in centrifugal force pushes the pawl 14 outward from the center to the internal threads 12. Once forced outwardly and received into the internal threads 12, the pawl 14 locks. This locking halts the rotation of the drum 11, which in turn, stops the fall of the mast 1. The pawl 14 has a pivot link 15 with the rotor 13 that allows the pawl 14 to rotate with the rotor 13. This pivot link 15 also allows the outward movement of the pawl 14 due to centrifugal force. The rotor 13 has a cut-out that spans approximately a quarter of the opening, the cut-out representing the area occupied by the pawl 14.

Both flanges 22 of the drum 11 have rotors 13 and pawls 14 extended by an integral knob 18 from the middle of rotors 13 to connect the axle shaft with other components, as shown in FIG. 6B. The integral knob 18 extends from one end to the other end of the drum 11. At one end of integral knob 18 is a handle 16. The integral knob 18 may be shaped as illustrated in FIG. 6B such that the integral knob 18 can be fitted into a corresponding slot within the axle shaft, which rotationally couples the axle shaft and the integral knob 18. A torsion spring 17 in FIG. 6A is used to provide a space between the rotor 13 and an S-shape plate 20 in FIG. 6B. Torsion spring 17 prevents both the rotor 13 and the S-shape plate 20 from sticking together. More specifically, the torsion spring 17 provides frequent spring motion for the S-shape plate 20 that attenuates vibration during normal operation, such as hoisting the mast 1. Furthermore, the torsion spring 17 retains the pawl 14 from locking and braking if the rotation speed is less than a certain threshold value. The threshold value may depend on the specification of a mast system such as weight of a mast and power of a drawworks. For example, a spool 8 in accordance with one or more embodiments may activate if the rotation speed exceeds 10% of the falling speed of the mast 1. If the falling speed of the mast 1 in this embodiment corresponds to 60 revolutions per minute (RPM) according to the size of the pawl 14 and the rotor 13, then the threshold may be set at 10% of the 60 RPM of the falling speed of the mast 1. The computed threshold value, 6 RPM in this embodiment, may ensure that the pawl 14 is not moved and received into the internal threads 12 when the rotation speed is less than 6 RPM. The value of the threshold may also change according to the size of the mast 1 and the spool 8 in accordance with other embodiments.

The S-shape plate 20 has a wide aperture in the middle to guide and smoothen the rotation of the axle shaft. The S-shape plate 20 also has two guided pins 19, 23, one from the pawl 14 and the other from the cover. The pin 19 coming from the cover fits into a cavity 21 formed in the rotor 13. The cover has a flapper leg attached with a compression spring limiting the movement of the S-shape plate 20 to retain the pawl 14 from locking and braking in normal speed (speed less than a threshold) and also to keep the S-shape plate 20 in right balanced position. The cover has an aperture at the center of the integral knob 18 which extends from the axle shaft to the outside of the drum 11. At the end of this integral knob 18 a handle 16 is installed to let an operator unlock the drum if locked due to a falling of the mast 1. FIG. 6 shows a handle 16 disposed on a cover on a first flange 22 to manually rotate an axle shaft if the axle shaft is locked due to an activation of a mechanical brake in the spool 8. As seen in FIG. 6C, the first flange 22 further includes an opening with internal threads 12 where the shape of the internal threads 12 can be chosen from either one or combination of sharp, ACME, knuckle, square, and other conventionally known shapes of threads. This is to avoid any slipping between the internal threads 12 and a pawl 14 once the safety system 100 is activated. All of the components are enclosed in the cover for protection where the cover is attached with bolts, washers, locks, or any conventionally known attachment methods. At the top of both of the flanges of the spool 8, there are rollers 27 to protect the drum 11 from being damaged due to friction between the safety wireline 6 with the drum 11.

Figure 7:
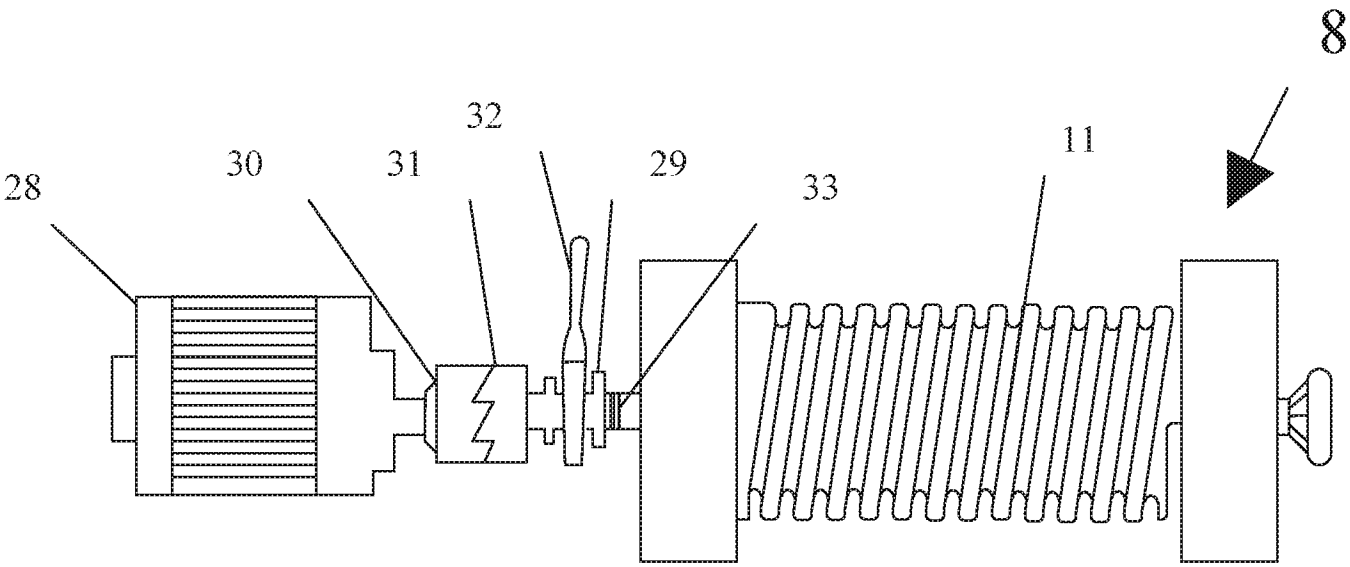
FIG. 7 shows a spool being connected to an external hoisting system when engaged in accordance with one or more embodiments.
Figure 7A:
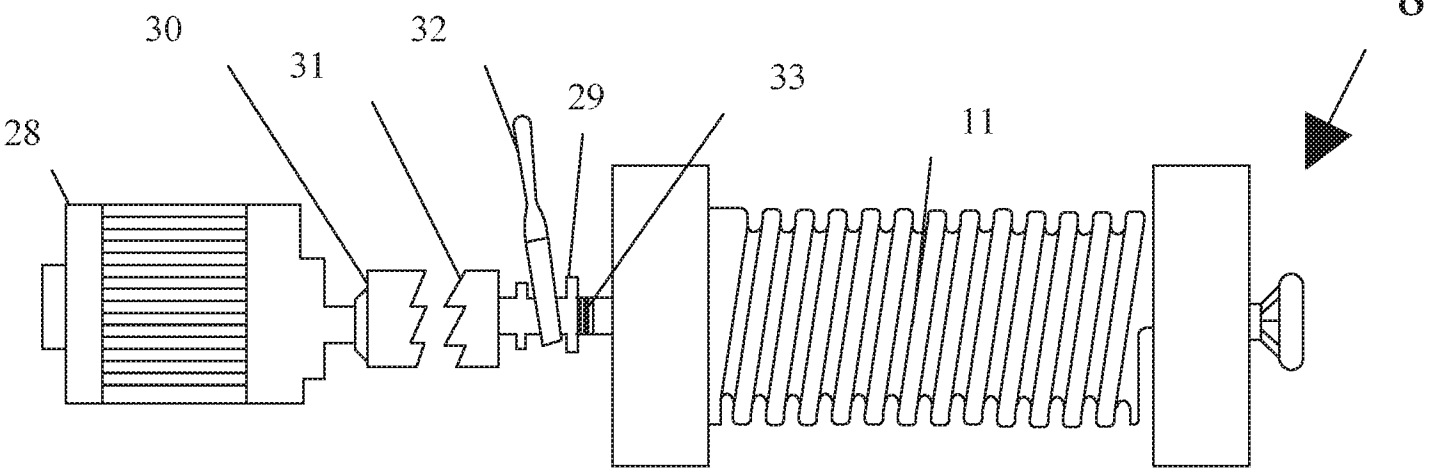
FIG. 7A shows a spool in FIG. 7 being disengaged.

FIG. 7 shows a spool 8 being engaged with an external hoisting system such as an electrical motor 28 in accordance with one or more embodiments. Again, spool 8 is shown without the safety wireline coiled around it in part for the ease of viewing and discussion. The electrical motor 28 is used to retrieve the safety wireline to the drum 11 or to help unlock the pawl if the pawl is locked. A key slot 29 connects a side of the axle shaft to a jaw clutch 30, 31. FIG. 7A shows a lever 32 used to disengage the spool 8 with the electrical motor 28 at the jaw clutch 30, 31. The engagement of the jaw clutch 30 enables the spool 8 to retrieve the safety wireline after the mast is fully lowered. During the disengagement, the lever 32 squeezes the spring 33 and makes a space between the clutch jaw 31 closed to the drum 11 and the other jaw 30 connected to the electrical motor 28. During the engagement, the lever 32 is in vertical position and the spring 33 is in its normal position, as shown in FIG. 7.

Figure 12:
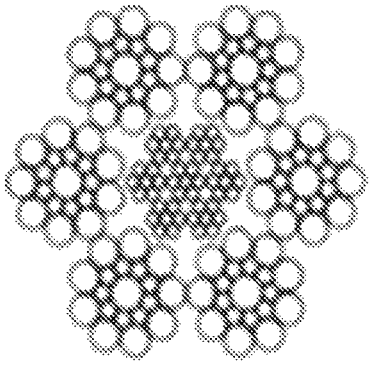
FIG. 12 shows a structure of strands of a safety wireline in accordance with one or more embodiments.

A safety wireline in accordance with one or more embodiments is a multi-threaded and twisted wire rope that is threaded or reeved. The safety wireline is made of strands wound around a steel core. For example, FIG. 12 illustrates an example of a structure of strands wound around a steel core used for a safety system. Each strand contains a number of small wires wound around a central core. This size for this safety wireline should be greater than or equal to that of a drilling line to ensure a safe condition in working load. The safety wireline has three parts, namely a core, strands and wires.

Figure 8:
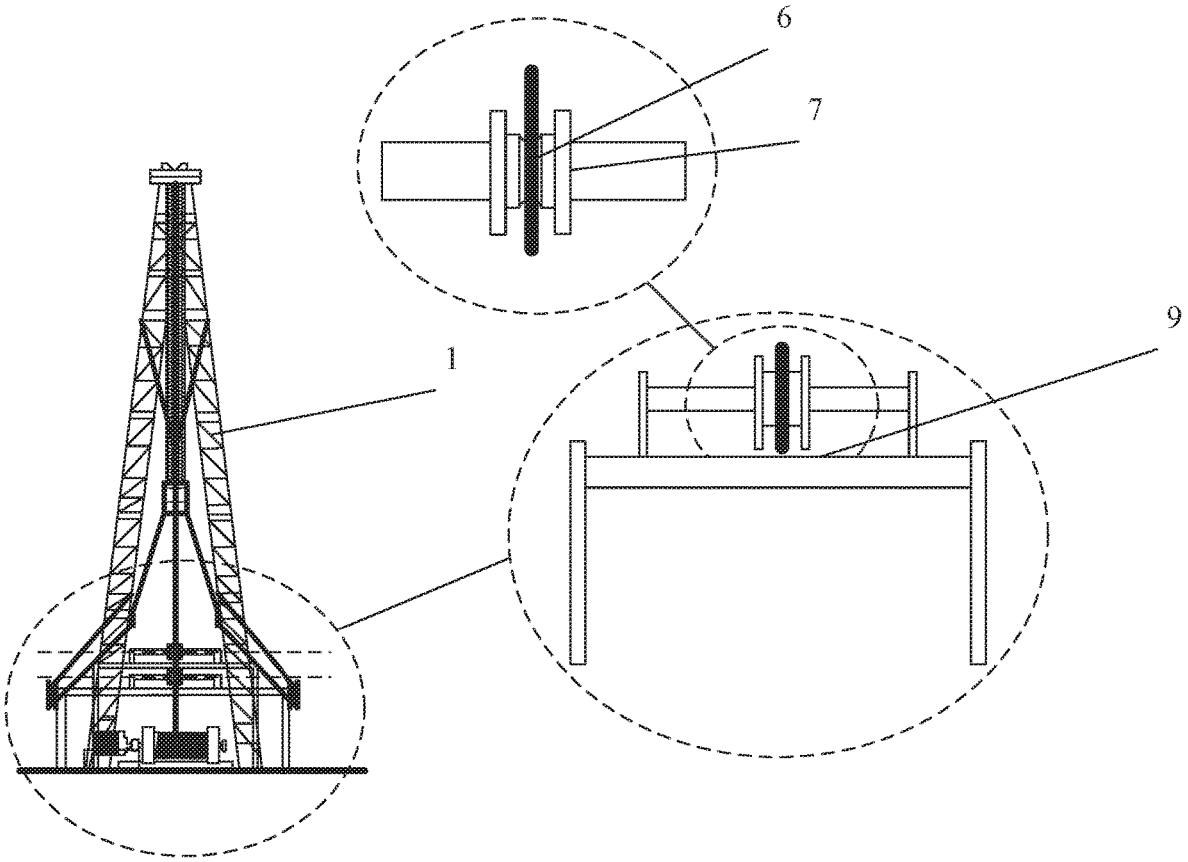
FIG. 8 shows an enlarged portion of an A-frame in accordance with one or more embodiments.

FIG. 8 shows an enlarged portion of a sheave 7 guiding a safety wireline 6 in FIG. 5. The sheave 7 is made of high strength steel configured to bear the load due to the tension in the safety wireline 6 when the mast 1 descends in an uncontrolled manner. A sheave 7 in accordance with other embodiments may be made of other material that is capable of carrying the weight of mast weight. The groove on the sheave 7 is manufactured by undergoing middle-frequency quenching in order to strengthen the groove and to extend its operating life. A sheave 7 in one or more embodiments is assembled on an A-frame 9 with double-conical bearing where each bearing has its individual lubricating channel.

Figure 9:
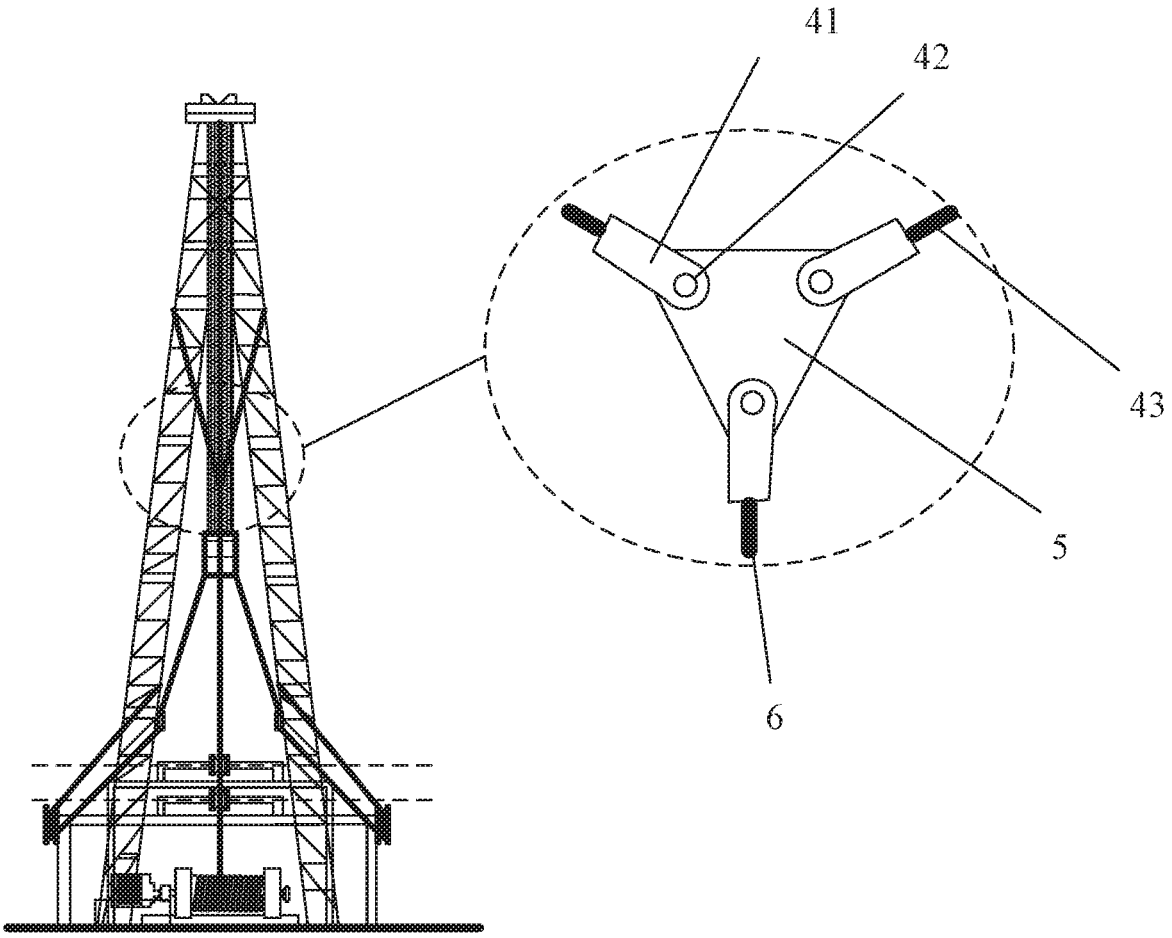
FIG. 9 shows a three-point connector in accordance with one or more embodiments.

FIG. 9 shows an enlarged portion of a three-point connector 5 in accordance with one or more embodiments. The three-point connector includes three holes for the safety wire pins 42 to distribute the load in one safety wireline 6 into two sling lines 43. A socket 41 is used to fasten the sling wires 43 and safety wireline 6 to the three-point connector. Specifically, the two separate sling wires 43 are connected to the three-point connector 5 at two holes, and the three-point connector 5 is connected to the safety wireline 6 at the other hole. This way of connection further avoids unwanted contact between the drilling line and the safety wireline 6. This way of coupling also ensures that each sling wire 43, the three-point connector 5 and the safety wireline 6 do not contact each other.

Figure 10:
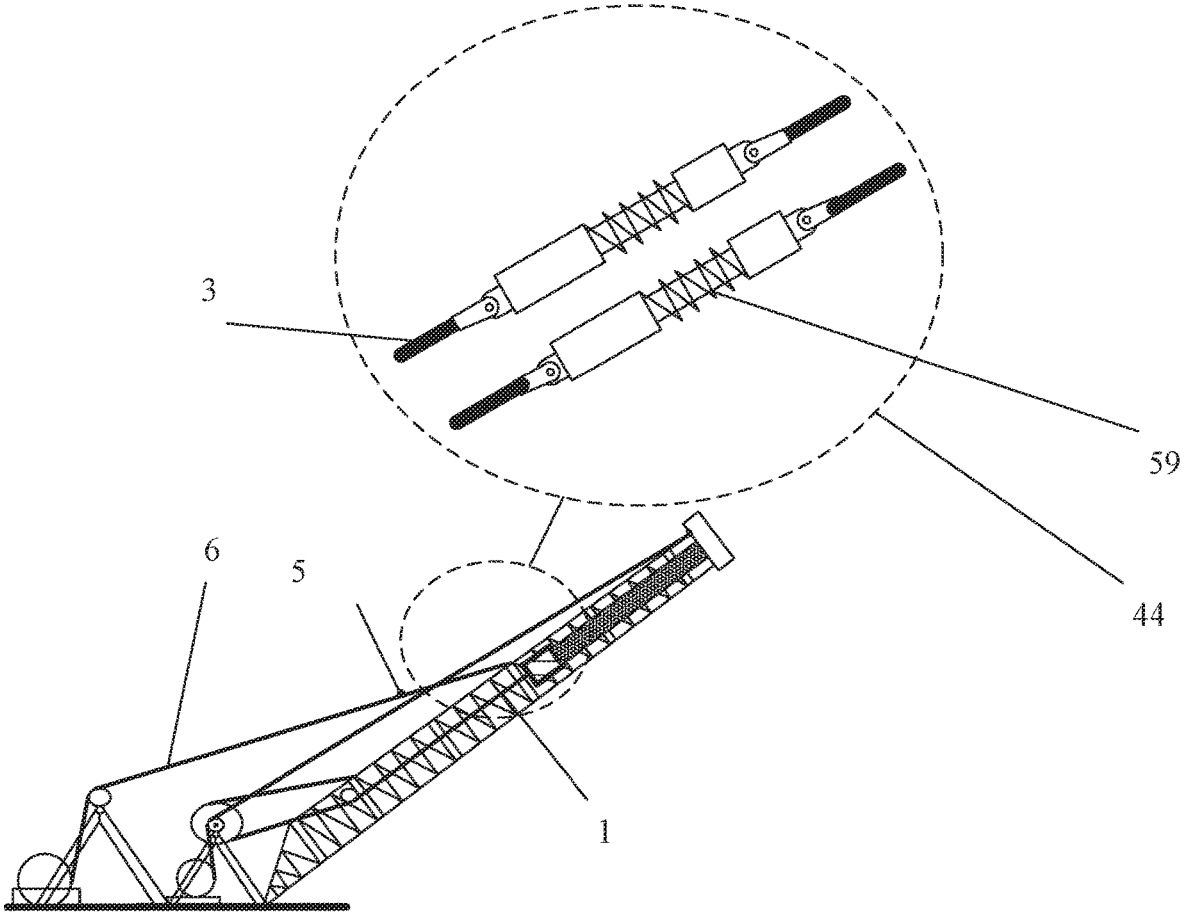
FIG. 10 shows shock absorber jacks in accordance with one or more embodiments.

FIG. 10 shows shock absorber jacks 44 including springs 59 to reduce and attenuate the vibrations on the mast 1 and the safety wireline 6. The frequency of vibrations emanating from the safety wireline 6 is approximately ten times higher than the vibrations of the mast 1. The shock absorber jacks 44 are the means to dampen such undesired vibrations or shocks.

Figure 11:
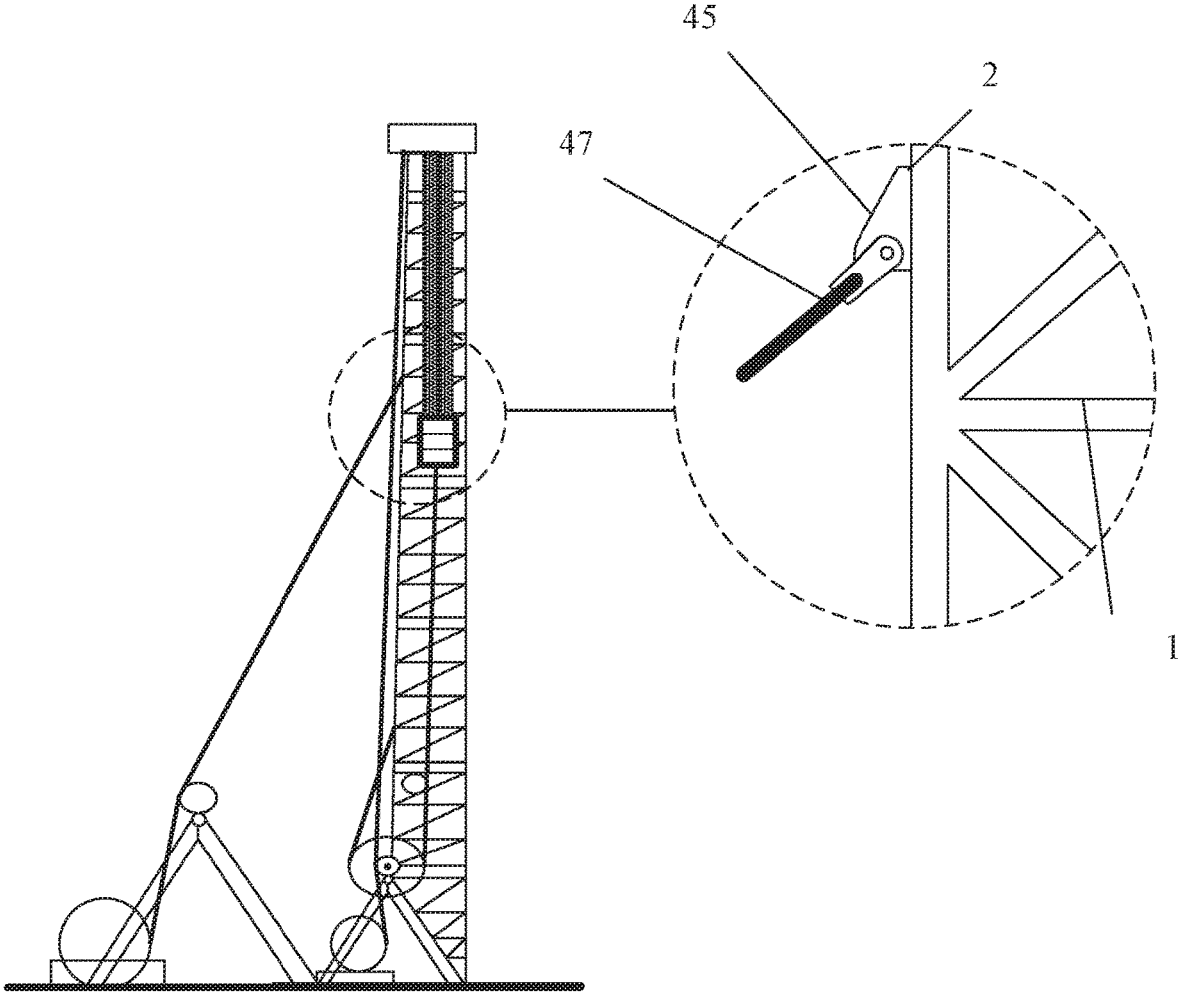
FIG. 11 shows a pad eye on a mast in accordance with one or more embodiments.

FIG. 11 shows a pad eye 45 used to couple the sling wires 47 to the mast 1 using a socket with lock pins to facilitate lifting of the mast 1 with sling wires 47. The pad eye 45 may vary in size and shape based on the required safe working load. Specifically, the actual diameter of the hole, plate thickness, and other dimensions of the pad eye 45 varies according to the chosen safe working load which considers a load of the mast 1, gravity force, bearing stress, shear stress, tensile stress and combined bending and tensile stress—Von-Mises stress. In particular, the pad eye 45 is mounted on desired locations 2 on the mast 1, and connected to two separate wires 47 (sling wires) followed by shock absorber jacks 44 and another set of sling wires 47.

A method associated with using a safety system in accordance with one or more embodiments may include coupling one end of the safety wireline 6 to a mast 1 by using a three-point connector 5, a plurality of sling wires 3, and a plurality of shock absorber jacks 44, as shown in FIG. 10. The other end of the safety wireline 6 remains anchored to a wall 37 of a drum 11 in a spool 8, as shown in FIG. 6. Once the mast 1 is raised to an operating position, such as shown in FIG. 1, a safety system 100 may be applied to a mast system 50 such as shown in FIG. 3. The spool 8 is rotated in coordination with the drawworks 10 such that the pawl 14 is maintained in a position that allows the rotation of the spool 8. The spool 8 is rotated until the safety wireline 6 is in tension in order to avoid any accidental fall of the mast 1 due to sagged safety wireline 6. One skilled in the art would appreciate how the method immediately detects the falling of the mast 1 once the falling accident occurs without any delays because the safety wireline 6 is maintained in tension.

Positions of components of a mechanical brake in the spool 8, mainly a pawl 14, is maintained while the rotation speed is less than or equal to a threshold (that is, 6 RPM), as shown in FIG. 6A where pawl 14 stays with the rotor 13 without being received to the internal threads 12. When the rotation speed exceeds the threshold, the pawl 14 moves to a different position to engage with the internal threads 12 of the spool 8 due to an increase in centrifugal force, which locks further rotation of the drum 11. One skilled in the art would appreciate how the safety system 100 would mitigate the complete collapse of the mast 1 even when a failure occurs in the drawworks itself, because the safety system 100 is a separately working system that activates upon centrifugal force. The safety system 100 in accordance with one or more embodiments does not rely on power supply such as electricity. This further gives a benefit of the safety system 100 over other currently available safety systems that may fail if a failure occurs in the power supply because of their reliance on electricity.

While the disclosure has been described with respect to a limited number of embodiments, those skilled in the art, having the benefit of this disclosure, will appreciate that other embodiments can be devised that do not depart from the scope of the disclosure as described. Accordingly, the scope of the disclosure should be limited only by the accompanying claims.

What is claimed:

1. A system comprising:

a spool comprising:

a drum rotatably supported on an axle shaft, first and second flanges integrally formed with opposite ends of the drum, both having an opening and internal threads circumscribing the opening, and a plurality of mechanical brakes, each mechanical brake comprising:

a rotor rotatably supported on the axle shaft, and a pawl configured to engage with the internal threads circumscribing the opening, where the rotor and the pawl are arranged within the opening, and where the pawl is pivotally linked to the rotor such that when the rotation of the axle shaft is in a rotation direction and at a rotation speed that exceeds a threshold then the pawl is moved by centrifugal force and engages with the internal threads circumscribing the opening and does not permit the spool to rotate, and a safety wireline having a first end and a second end, where the first end is anchored to the drum and the second end is configured to be coupled to a mast.

2. The system in claim 1 where the spool is fixed on a portable plate disposed at a distance from a drawworks for the mast.

3. The system in claim 1 where the spool further comprises an S-shaped plate with an aperture at the center to guide the rotation of the axle shaft.

4. The system in claim 3 where the spool further comprises a torsion spring configured to attenuate vibration and to maintain positions of the rotor and the S-shaped plate.

5. The system in claim 3 where the spool further comprises a flapper leg with a compression spring configured to limit motion of the S-shape plate and to retain the pawl from locking in normal speed.

6. The system in claim 1 where the drum further comprises a continuous groove on the outer surface of the drum to guide a safety wireline.

7. The system in claim 1 where the drum further comprises rollers at the top of the flanges to protect the drum from friction between the safety wireline and the drum.

8. The system in claim 1 further comprising a three-point connector, where a first point of the three-point connector is coupled to the second end of the safety wireline and the second and third points are each coupled to a separate sling wire, where each sling wire is configured to be coupled to the mast at different points.

9. The system of claim 8, where the coupling of the safety wireline to the mast is such that the combination of sling wires, the three-point connector and the safety wireline do not contact a drilling line from a drawworks for the mast.

10. The system in claim 1 further comprising a shock absorber jack, where the shock absorber jack is configured to be coupled to each of the mast and to the safety wireline using a sling wire.

11. The system of claim 1 where the safety wireline is coupled to the mast at two points using a three-point connector, a plurality of sling wires, and a plurality of shock absorber jacks.

12. The system in claim 1 where the spool is configured to be engaged and disengaged with an external drive using a jaw clutch.

13. The system in claim 1 where the spool is rotated by an external drive and is configured to retrieve the safety wireline.

14. A spool comprising:

a drum, an axle shaft rotatably supporting the drum, first and second flanges integrally formed with opposite ends of the drum, both having an opening and internal threads circumscribing the opening, and a plurality of mechanical brakes, each mechanical brake comprising:

a rotor rotatably supported on the axle shaft, and a pawl configured to engage with the internal threads circumscribing the opening, where the rotor and the pawl are arranged within the opening, and where the pawl is pivotally linked to the rotor such that when the rotation of the axle shaft is in a rotation direction and at a rotation speed that exceeds a threshold then the pawl is moved by centrifugal force and engages with the internal threads circumscribing the opening and does not permit the spool to rotate.

15. The spool in claim 14 further comprising an S-shaped plate with an aperture at the center to guide the rotation of the axle shaft.

16. The spool in claim 15 where the spool further comprises a torsion spring configured to attenuate vibration and to maintain positions of the rotor and the S-shaped plate.

17. The spool in claim 15 where the spool further comprises a flapper leg with a compression spring configured to limit motion of the S-shape plate and to retain the pawl from locking in normal speed.

18. The spool in claim 14 where the drum further comprises a continuous groove on the outer surface of the drum to guide a safety wireline.

19. The spool in claim 14 where the drum further comprises rollers at the top of the flange to protect the drum from friction between the safety wireline and the drum.

* * * * *